US005556692A

United States Patent [19]

Zheng

[11] Patent Number: 5,556,692

[45] Date of Patent: Sep. 17, 1996

[54] DUAL PURPOSE PARKING PAD

[76] Inventor: Joe Zheng, P.O. Box 2083, Danbury, Conn. 06804

[21] Appl. No.: 362,172

[22] Filed: Dec. 22, 1994

[51] Int. Cl.[6] ..... B32B 3/00

[52] U.S. Cl. ..... 428/156; 428/131; 428/137; 428/172; 428/192; 428/213; 296/38; 184/106; 222/108

[58] Field of Search ..... 428/156, 172, 428/192, 131, 137, 213; 296/38; 5/417; 184/106; 104/133; 222/108; 188/32

[56] References Cited

U.S. PATENT DOCUMENTS

| | | | |
|---|---|---|---|
| 4,246,982 | 1/1981 | Pretnick | 184/106 |
| 4,684,562 | 8/1987 | Hartkemcyer | 428/182 |
| 5,248,540 | 9/1993 | Speckman et al. | 428/101 |
| 5,266,378 | 11/1993 | Stephenson et al. | 428/156 |
| 5,308,670 | 5/1994 | Saylor | 428/81 |
| 5,350,619 | 9/1994 | Rasmussen | 428/167 |

*Primary Examiner*—Donald Loney
*Attorney, Agent, or Firm*—Zheng, Joe; Lin & Li

[57] ABSTRACT

A parking pad having a raised wall, a bump and a slope is disclosed. A pair of such parking pads are preferably placed in an indoor garage for a vehicle to park thereon. The parking pad is made out of a single material and provides two purposes, one being used to collect and retain droppings falling from a parked vehicle in an indoor garage and the other being a parking guide for the vehicle to be parked properly.

9 Claims, 3 Drawing Sheets

DUAL PURPOSE PARKING PAD

FIELD OF INVENTION

The present invention relates to work holders and more particularly relates to parking pads for a parked vehicle in an indoor garage.

DESCRIPTION OF THE RELATED ART

Many single family houses in United States have an indoor garage. Vehicles parked in the garage usually bring in mud and dirt, and worse, snow, water, sand, solvents in foul weathers. In many occasions, water including melting snow runs all over the floor in the garage and the droppings falling from the vehicle are spread by the flowing water and eventually brought into rooms by stepping around.

U.S. Pat. No. 5,308,670 to Saylor discloses a floor cover for a parked vehicle. The floor cover has the size of the vehicle and a raised edge around the cover makes a basin to collect and retain melting snow, water, sand, solvents, oils, mud and dirt falling off the vehicle. The raised edge is formed by inserting a rubber hose in the folded edge around the cover.

The above disclosed floor cover has a fixed size suitable for one vehicle and can be too small or too large for other vehicles of different size. If the size is too small for a vehicle, the cover may not efficiently collect the droppings falling from the sides of the vehicle. If the size is too large, the extra space beyond the vehicle may be in the way of the vehicle operator in the garage. In addition, a vehicle has to cross over the raised edge every time the vehicle is parked and operated. The repeated high pressure on the same side may damage the raised edge and spill the collected water through the pressed edge. It is observed in reality that many external droppings including melting snow, sand, dirt from a vehicle are located around the wheels of the vehicle and fall along the sides of the vehicle. A vehicle of good conditions should not have internal droppings such as engine oil, coolant and other mechanical fluids in the middle. The external droppings are therefore the main problem in a parking garage. The majority of the space in the center of the cover is in general unused but imposes a burden of storing and cleaning the cover.

To protect the house structure and keep the garage dry and clean, home owners hope to prevent the droppings from spreading all over the garage when the vehicle inevitably bring in snow, water, salt and sand in a foul weather. There is therefore a great need for a parking pad which can be used to efficiently collect and retain the droppings falling off a parked vehicle in an indoor garage. Many indoor garages have a tight space for vehicles to park, there has further been a need that a parking pad may serve as a parking guide to help an operator of a vehicle to park the vehicle properly in a garage of tight space without hitting the garage wall or other objects placed just before the parking space.

SUMMARY OF THE INVENTION

The present invention has been made in consideration of the above described problems and needs. The parking pad disclosed comprises an elongated flat board with two sides and two ends. The board is surrounded along the two sides and one end by a wall raised above the surface of the board to form a guiding track for the vehicle to move along with and a bucket for collecting the droppings from the vehicle. A trough is formed around the board to assist to drain the droppings and makes it easy to clean the parking pad when necessary. To help the operator to park the vehicle properly, a raised bump is attached to the surface of the flat board. The operator can get a feeling and apply brakes when the front wheel of the vehicle hits the bump. Therefore the parking pad can also be used in a garage of small size. It can be appreciated in the following detailed description, a pair of such parking pads are preferable for both sides of a vehicle.

Accordingly, an important object of the present invention is to provide a generic parking pad which can used as a parking guide in an indoor garage meanwhile can be used as a bucket to collect droppings falling off a parked vehicle.

Another object of the invention is to provide a portable parking pad which is easily removed and cleaned.

Still another objects of the invention is to have an easily adjustable parking pad for vehicles of different sizes.

Still another objects of the invention is to provide a parking pad which is easily manufactured.

Other objects, together with the forgoing are attained in the exercise of the invention in the following description and resulting in the embodiment illustrated in the accompanying drawings.

PREFERRED EMBODIMENT—DESCRIPTION

Figure 1:
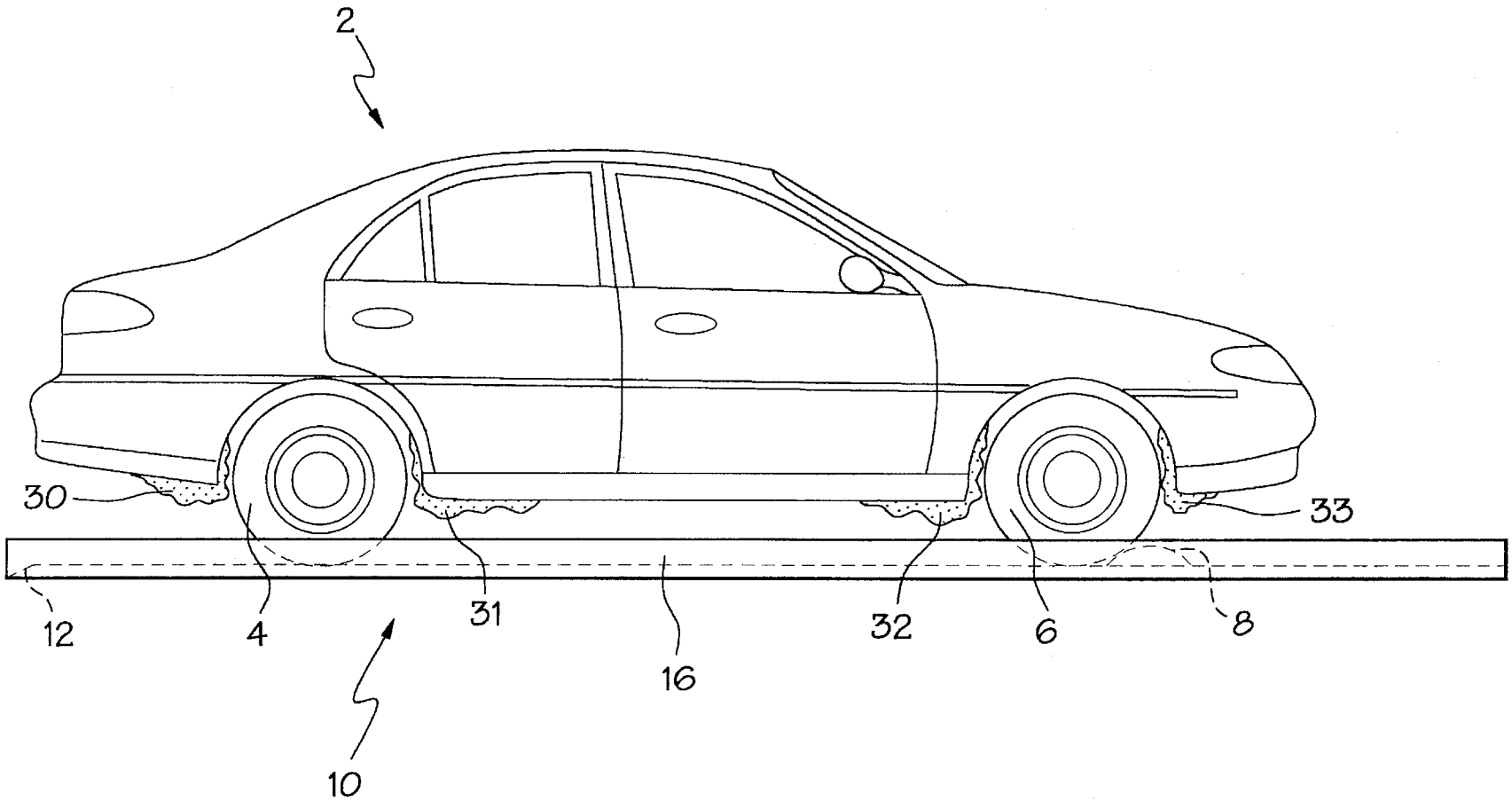
FIG. 1 demonstrates a bottom portion of a vehicle parked on the parking pad.

Referring now to the drawings, in which like numerals refer to like parts throughout the several views. FIG. 1 shows a bottom part 2 of a vehicle parked on the parking pad 10. The parking pad 10 is made out of a single material which could be any water-proof material such as vinyl plastic and can also be in different color such as orange to be more visible. The droppings labeled as 30, 31, 32, 33 are snow or mud accumulated around the wheels 4, 6 of the vehicle, which is commonly seen in a foul weather, and drop into the parking pad 10. The vehicle is properly positioned as the front wheel 6 touches the bump 8.

Figure 2:
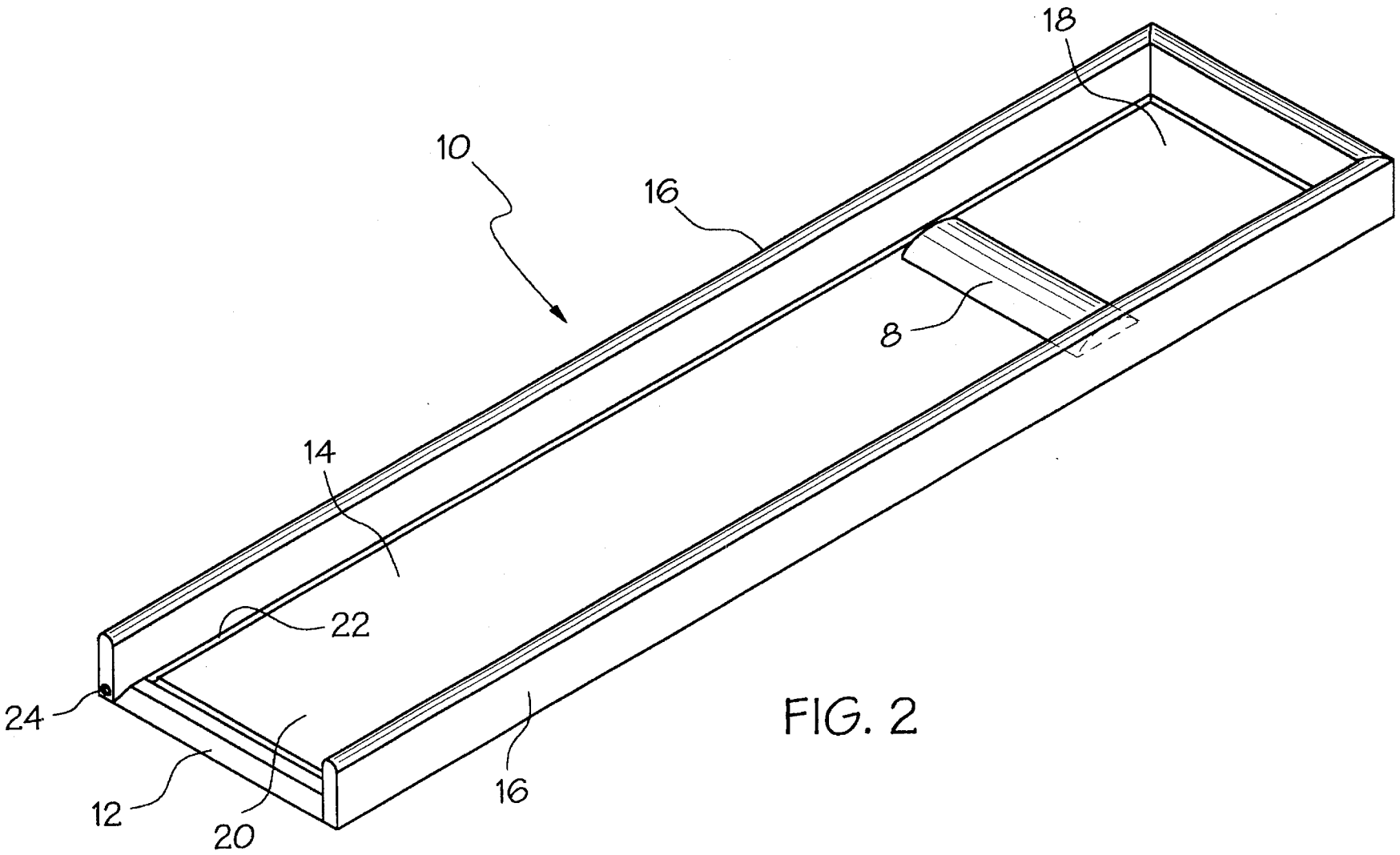
FIG. 2 shows a perspective view of the parking pad.
Figure 3:
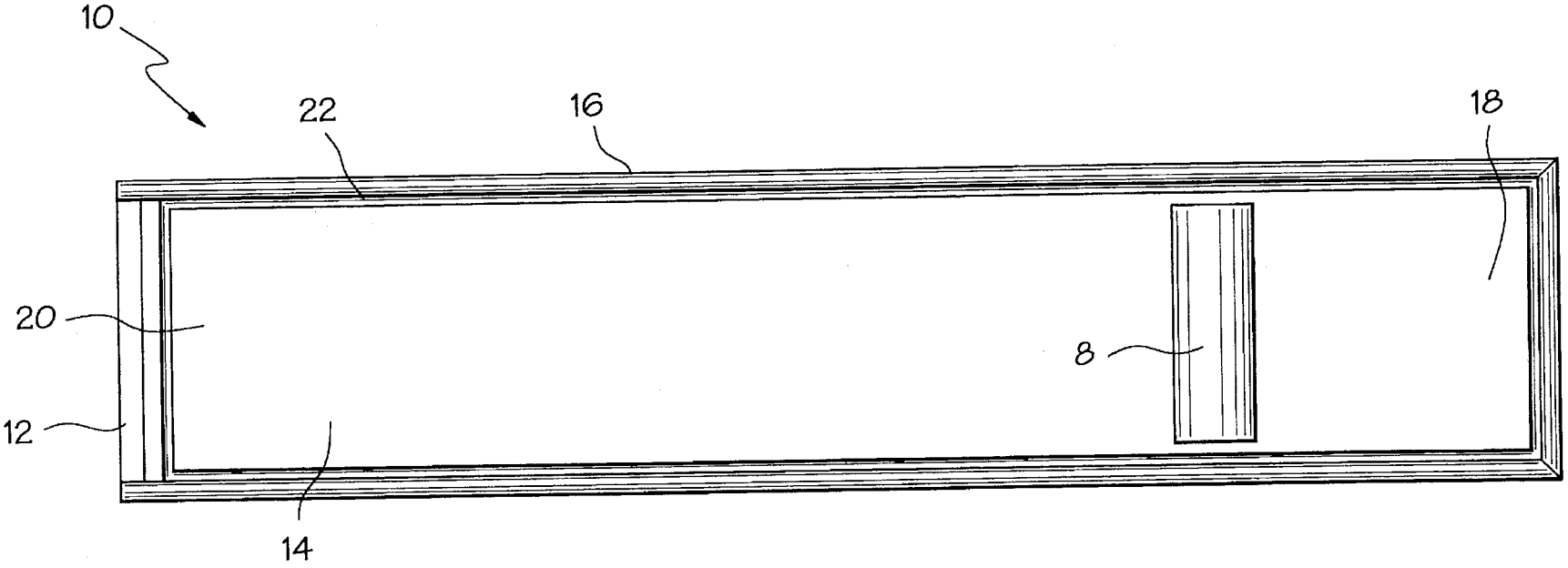
FIG. 3 shows a top view of the parking pad.

As more clearly illustrated in FIG. 2, the parking pad 10 comprises a elongated flat board which has a length of a regular vehicle, for example 140 inches. The board is generally rectangular, two long sides and two short sides. The short side is about as twice as the width of a regular vehicle wheel, for example 20 inches. A wall 16 is raised around the two long sides and one short side 18 of the flat board and integral with the board to form a bucket to collect the droppings falling from the vehicle. To assist the vehicle to smoothly get on the board surface 14, the other short side 20 of the board is made a slope 12. A raised bump 8 is attached to the surface 14 so that the operator is notified the proper position of the vehicle. To drain the fluid droppings, a draining trough 22 is formed around the board surface as shown clearly in FIG. 3. An opening 24 having a passage to the draining trough is made at one end of the wall 16. The opening 24 can be made connectable to regular garden hoses which go to housing drainage system. The arrangement of the opening to a garden hose makes it possible to drain the collected fluid falling from the vehicle and clean the board without moving the pad in the garage.

As described, a pair of such parking pads are preferable for one vehicle. A pair of adjustable rods may be employed to link the parking pads together so as to control the distance therebetween. The lateral distance between the pairs is thus adjustable to the vehicle size.

Although the present invention has been described in considerable detail with reference to certain embodiment thereof, other versions are possible. For example, the thickness of the board can be made inclined from one end to the other of the board, so that the collected droppings can be timely drained. Therefore, the spirit and scope of the appended claims should not be limited to the description of the preferred embodiment contained herein.

What is claimed is:

1. A parking pad for a vehicle for collecting droppings falling from the vehicle and signaling the operator of the vehicle to park the vehicle properly, the pad comprising:

an elongated member of a similar length of the vehicle, having a flat surface, two sides, first and second ends, the first end having a slope for the vehicle to smoothly move onto the surface of the elongated member; the second end being elevated so that the flat surface is inclined;

a wall raised above the flat surface and extending along the two sides and the second end and being integral with the elongated member;

a bump pad being positioned between the two sides and close to the second end; and means for attaching the bump pad to the surface of the elongated member.

2. A parking pad as recited in claim 1 further including a draining opening located substantially near the first end to facilitate drainage of the drippings collected therein.

3. A parking pad as recited in claim 2 further including a trough going along the two sides and the second end of the elongated member and surrounded by the wall, the trough further going along the first end of the elongated member, the draining opening communicating with the trough for draining the droppings collected therein.

4. A parking pad as recited in claim 2 further including a trough going along the first end of the elongated member and communicating with the draining opening for draining the droppings collected therein.

5. A parking pad for a vehicle for collecting droppings falling from the vehicle and signaling the operator of the vehicle to park the vehicle properly, the pad comprising:

a first and a second elongated member, each comprising:

a flat surface, two sides, first and second ends; the first end having a slope for the vehicle to smoothly move onto the surface of the elongated member, the second end being elevated so that the flat surface is inclined;

a wall raised above the flat surface and extending along the two sides and the second end;

a wall raised above the flat surface and extending along the two sides and the second end, the wall being integral with the elongated member;

a bump pad being positioned between the two sides and close to the second end; and means for attaching the bump pad to the surface of the elongated member; and adjustable means for keeping the first elongated member in parallel away from the second elongated member so that the first elongated member is positioned under one side of the vehicle and the second elongated member is positioned under the other side of the vehicle.

6. A parking pad as recited in claim 5 wherein the adjustable means is a pair of adjustable rods.

7. A parking pad as recited in claim 5 wherein each of the elongated members has a draining opening located substantially near the first end thereof to facilitate drainage of the drippings collected therein.

8. A parking pad as recited in claim 7 wherein each of the elongated members has a trough and the trough communicating with the draining opening for draining the droppings collected therein.

9. A parking pad as recited in claim 5 wherein each of the elongated members has a length similar to the vehicle.

* * * * *